US009822582B2

(12) United States Patent
Larsen

(10) Patent No.: US 9,822,582 B2
(45) Date of Patent: Nov. 21, 2017

(54) WINDOW COVERING WITH ADJUSTABLE SECUREMENT MECHANISMS

(71) Applicant: Danelle Larsen, Highlands Ranch, CO (US)

(72) Inventor: Danelle Larsen, Highlands Ranch, CO (US)

( * ) Notice: Subject to any disclaimer, the term of this patent is extended or adjusted under 35 U.S.C. 154(b) by 59 days.

(21) Appl. No.: 14/885,988

(22) Filed: Oct. 16, 2015

(65) Prior Publication Data

US 2017/0107756 A1 Apr. 20, 2017

(51) Int. Cl.

| | |
|---|---|
| ***E06B 9/15*** | (2006.01) |
| ***E06B 9/24*** | (2006.01) |
| ***E06B 7/00*** | (2006.01) |
| ***E06B 9/06*** | (2006.01) |
| ***E06B 9/264*** | (2006.01) |

(52) U.S. Cl.

CPC ..... *E06B 9/24* (2013.01); *E06B 7/00* (2013.01); *E06B 9/0692* (2013.01); *E06B 9/264* (2013.01); *E06B 2009/2482* (2013.01)

(58) Field of Classification Search

CPC . E06B 9/24; E06B 9/262; E06B 9/264; E06B 9/0692; E06B 2009/2482; E06B 7/00; A44B 19/34

USPC ..... 160/348, 349.1, 349.2, 389

See application file for complete search history.

(56) References Cited

U.S. PATENT DOCUMENTS

| | | | | |
|---|---|---|---|---|
| 4,326,577 | A * | 4/1982 | Tse | E06B 9/40 160/259 |
| 5,025,848 | A * | 6/1991 | Prochaska | A47H 1/18 160/243 |
| 7,195,051 | B2 * | 3/2007 | Nien | E06B 9/40 160/243 |
| 7,942,186 | B2 * | 5/2011 | Lassiter | A47H 19/00 160/348 |
| 2005/0199356 | A1 * | 9/2005 | Nien | E06B 9/262 160/348 |
| 2011/0155199 | A1 * | 6/2011 | Harper | E04H 15/32 135/143 |
| 2012/0193043 | A1 * | 8/2012 | Bishop | E06B 9/262 160/370 |

* cited by examiner

*Primary Examiner* — Katherine Mitchell
*Assistant Examiner* — Abe Massad

(57) ABSTRACT

Disclosed herein is a window covering having adjustable securement mechanisms that are operable to secure at least a portion of the window covering at a certain location once the window covering has been manipulated. As described, the window covering includes a panel and at least one guide coupled to a first side of the panel. The window covering also includes at least one sliding securement mechanism coupled to the guide. The at least one sliding securement mechanism is operative to move along the guide and secure at least a portion of the panel at different positions along the guide.

20 Claims, 6 Drawing Sheets

WINDOW COVERING WITH ADJUSTABLE SECUREMENT MECHANISMS

FIELD

The present disclosure generally relates to window coverings. More specifically, the present disclosure is directed window coverings having adjustable securement mechanisms that enable the window covering to be drawn at adjustable levels.

BACKGROUND

Treatments and coverings for windows, doors, and other architectural openings are typically provided in a number of fabrics and styles. The different styles include venetian blinds, vertical blinds, mini-blinds, drapes, shades, and the like. However, some of these window treatments include cords that enable the window treatments to move from a closed position to an open position and vice versa. However, these cords typically tangle and may be hazardous to children.

In addition to the above, these window treatments are typically secured directly to the window casing and may not be moved. As such, these window treatments may always block the same portion of the window.

SUMMARY

Disclosed herein is a window covering having one or more sliding securement mechanisms. When the sliding securement mechanisms are positioned at a particular location on the window covering, a portion (e.g., a bottom portion) of the window covering may be drawn, rolled, folded, bent or otherwise manipulated to that particular location. The window covering is then coupled to the sliding securement mechanisms thereby adjusting a length of the window covering.

More specifically, the window covering comprises a panel and at least one guide coupled to a first side of the panel. The window covering also includes at least one sliding securement mechanism coupled to the guide. The at least one sliding securement mechanism is operative to move along the guide and secures at least a portion of the panel at different positions along the guide.

Also disclosed is a window covering having at least one guide. The at least one guide extends from a first portion of the window covering to a second portion of the window covering. The window covering also includes a securement mechanism moveably coupled to the guide. An attachment mechanism is coupled to a second side of the window covering and is positioned opposite from the at least one guide.

In still yet another embodiment, a window covering having a first guide and a second guide is disclosed. According to this embodiment, the first guide and the second guide extend substantially along a length of the window covering. A first securement mechanism is movably coupled to the first guide and a second securement mechanism is moveably coupled to the second guide. The first securement mechanism and the second securement mechanism secure at least a portion the window covering at a first position when the first securement mechanism and the second securement mechanism are located at the first position on their respective guides. The first securement mechanism and the second securement mechanism may also secure at least a portion of the window covering at a second position when the first securement mechanism and the second securement mechanism are located at the second position on their respective guides.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1B:
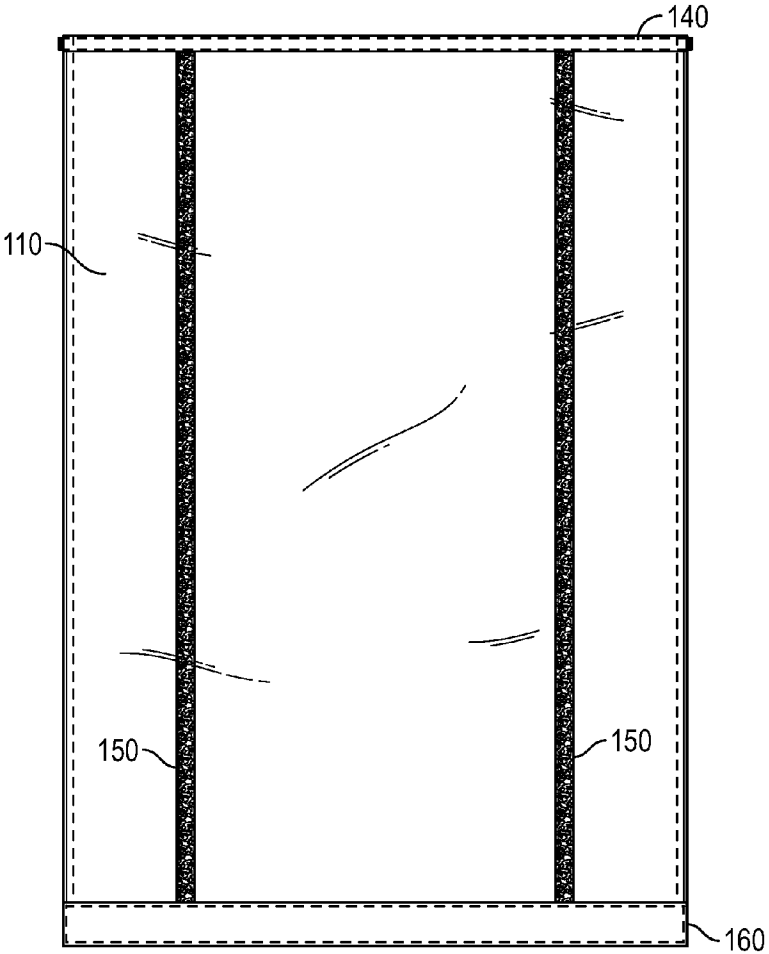
FIG. 1B illustrates a back side of the example window covering of FIG. 1A.

Reference will now be made in detail to representative embodiments illustrated in the accompanying drawings. It should be understood that the following descriptions are not intended to limit the embodiments to one preferred embodiment. Rather, the described embodiments are intended to cover alternatives, modifications, and equivalents as can be included within the spirit and scope of the embodiments described herein and as defined by the claims that are included herewith.

The embodiments described herein are directed to window coverings. More specifically, the described embodiments are directed to top-down, bottom-up window coverings. The phrase "top-down, bottom-up" means that the top portion of the window covering and a bottom portion of the window covering are both adjustable. For example, the top portion of the window covering may be secured at a first location within a window and the bottom portion of the window covering may be adjusted to give the window covering a desired length. The top portion may be subsequently moved to a second position, even when the bottom portion of the window covering has not been adjusted or is subsequently adjusted. Although top-down, bottom-up window coverings are specifically mentioned, the embodiments described herein may be used with any type of window coverings.

As used herein, the phrase "window covering" means a curtain, a shade, a blind, a valence, a drape, a shutter, or any type of covering that may be used to cover a window. The window covering may be made from any material and include various colors, patterns, features, designs and the like. Although the embodiments described herein refer to windows and window coverings, the various embodiments may be used in any openings for which a cover may be required or desired. For example, the embodiments described herein may be used with doors, closets, shower curtains, privacy screens, privacy drapes, and so on.

The window covering of the present disclosure includes or otherwise incorporates one or more moveable, adjustable or sliding securement mechanisms. More specifically and as will be described in detail below, the securement mechanisms are moveably coupled to one or more guides on a surface of the window covering. The guides extend along a length of the window covering. The securement mechanisms may move along the guides and be positioned and secured at any point along the guide. Once the securement mechanism has been placed at a desired location on the guide, the guide secures the securement mechanism at that location.

The window covering may then be drawn, folded, rolled, manipulated, or otherwise adjusted such that at least a portion of the window covering is removably coupled to the securement mechanism. For example, if the securement mechanism is located at a first location along the guide, a portion (e.g., a bottom portion) of the window covering may be drawn, folded, rolled, manipulated or otherwise adjusted such that the bottom portion of the window covering is removably coupled to the securement mechanism. As such, the securement mechanism may be used to adjust or otherwise change a length of the window covering.

As the window covering of the present disclosure uses one or more securement mechanisms to adjust its length, the window covering of the present disclosure may be cordless. That is, there are no cords, ropes, strings or the like that are used to draw, adjust a length or a position and/or change a shape or dimensions of the window covering. Although cords are not required, the various features described herein may be used or otherwise incorporated with window coverings having cords.

Figure 1A:
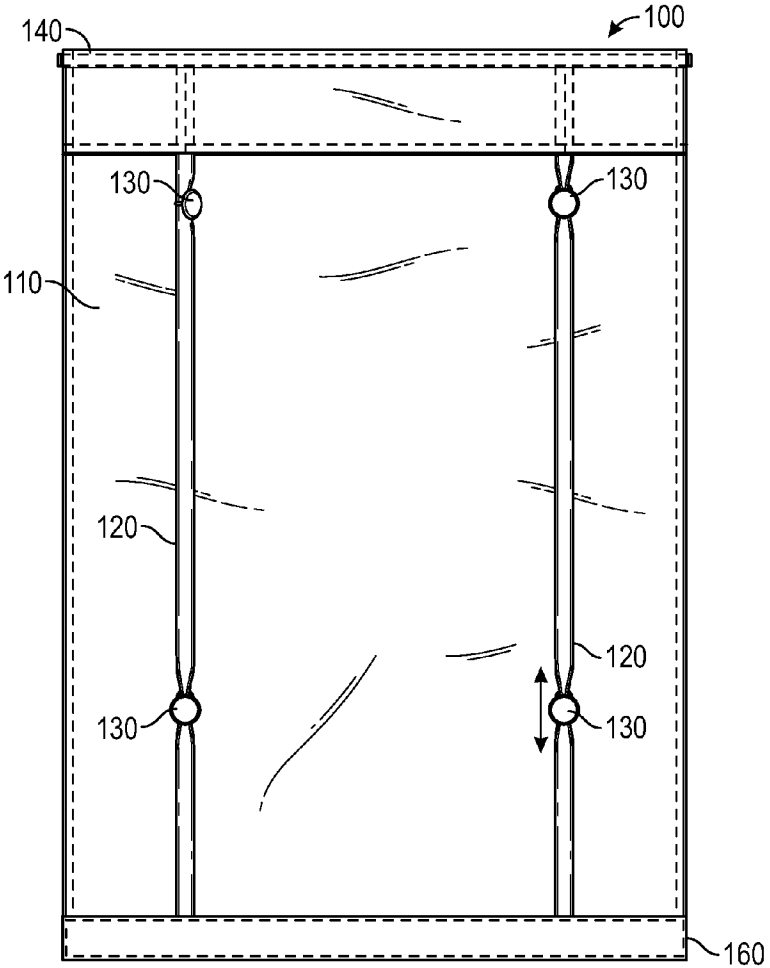
FIG. 1A illustrates an example window covering having sliding securement mechanisms.
Figure 1C:
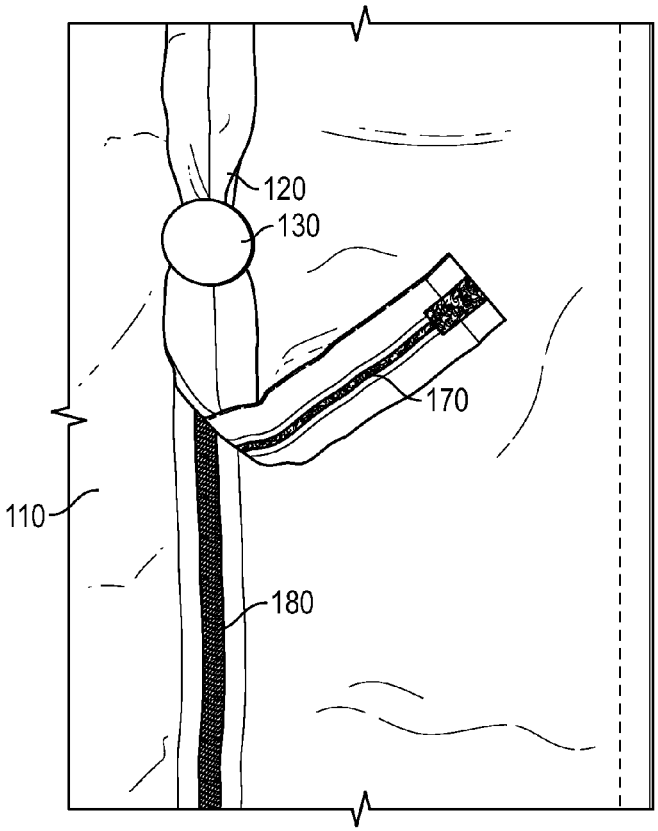
FIG. 1C illustrates a close-up view of a first portion of the example window covering of FIG. 1A.

FIGS. 1A-1C illustrate various views of an example window covering 100. The window covering 100 may include a panel 110, one or more guides 120 coupled to a first side of the panel 110, and one or more sliding securement mechanisms 130. The sliding securement mechanisms 130 are moveably coupled to each guide 120.

In some implementations, the window covering 100 may be made from a single panel 110. In another implementation, the panel 110 may be made up of smaller panels. In such embodiments, the smaller panels may be coupled together to form the larger panel 110. For example, the smaller panels may be removably coupled to one another.

The panel 110 may have one or more designs, colors, patterns and/or shapes although this is not required. Further, the panel 110 may have varying dimensions depending on the type of opening in which the panel 110 is to be used.

For example, the panel 110 may have a first set of dimensions to cover an opening (e.g., a window, a door and the like) of a first size. Likewise, the panel 110 may have a second set of dimensions to cover an opening of a second size.

The panel 110, or other portions of the window covering 100, may be made from a variety of materials. For example, the panel 110 may be made from any type of textile, fabric, cloth, or other such material. In some implementations, the window covering 100 may be made from plastic, wood, polymers, alloys and so on. For example, the panel 110 may be comprised of one or more plastic slats or wooden slats. These slats may be coupled together. In still yet another embodiment, the panel 110 or other portions of the window covering 100 may be made from any malleable, foldable or bendable material.

As briefly discussed above, the panel 110 may include one or more guides 120. The guides 120 may extend along an entire length of the panel 110, substantially along a length of the panel 110, a portion of the panel 110 and so on. Although two guides 120 are shown in the figures, the window covering 100 may incorporate any number of guides 120. Further, although the guides 120 are shown in a vertical orientation, the guides 120 may be arranged in a horizontal orientation, in a slanted or diagonal configuration and so on.

The guides 120 may be made from the same material (or a similar material) as the panel 110. In some embodiments, the guides 120 may be made from a material that is different from the panel 110. In other embodiments, the guides 120 may be made from a combination of materials (e.g., wood and cloth). The guides 120, or portions of the guides 120, may be integrated with the panel 110. Additionally or alternatively, the guides 120 may be removably coupled to a surface (e.g., an outer surface) of the panel 110.

In implementations in which multiple panels 110 are used, the guides 120 may be used as dividers between one or more panels 110. In another embodiment, the guides 120 or a portion of the guides 120 may be used to secure a first panel 110 to a second panel 110.

The window covering 100 may also include one or more securement mechanisms 130. The securement mechanisms 130 may be moveably coupled to the guide 130 and move in the direction of the arrow shown in FIG. 1A. Although a specific number of securement mechanisms 130 are shown, any number of securement mechanisms 130 may be used. For example, a window covering 100 may include two securement mechanisms 130, four securement mechanisms 130 and so on. In some embodiments, multiple securement mechanisms 130 may be coupled together. In such embodiments, different portions of the panel 110 may be secured to each securement mechanism 130. In other embodiments, a first securement mechanism 130 may be removably coupled to a second securement mechanism 130 and/or a portion of the panel 110.

In some embodiments, securement mechanisms 130 may be added and removed from the guides 120. For example, a portion of the guide 120, or the entire guide 120, may be removably coupled to the panel 110. When the guide 120 has been detached from the panel 110, securement mechanisms 130 may be added, removed or replaced.

The securement mechanisms 130 may be referred to herein as sliding securement mechanisms 130. The sliding securement mechanism 130 includes a component that enables it to move along and be positioned at any continuous location along the guides 120. For example, the sliding securement mechanism may include a sliding mechanism that is slideably coupled to the guide 120. In another implementation, the sliding securement mechanism 130 may include a component that causes the sliding securement mechanism 130 to maintain its position on the guide 120 using friction or other such force. In yet another implementation, the guide 120 may have one or more features (e.g., knots, protrusions, slots and so on) that act to temporarily or permanently secure the sliding securement mechanism 130 at a particular position. Further, in some cases, the features of the guide 120 may be moveable or otherwise positioned at various points along the guide 120.

In one embodiment, the guide 120 is threaded or otherwise placed through the sliding mechanism. As such and as will be explained in detail below, the securement mechanisms 130 may move along the guide 120 and may be used to adjust the length of the panel 110 to a continuous range of different lengths.

For example, as the securement mechanism 130 moves along the guide 120, the portion of the guide 120 adjacent the securement mechanism 130 may become temporarily decoupled from the panel 110. Once the securement mechanism 130 has been placed at the desired position on the guide 120, the guide 120 (or more specifically a portion of the guide 120 that is adjacent or otherwise surrounds or overlaps a portion of the securement mechanism 130) is recoupled to the panel 110 thereby securing the securement mechanism 130 at that position.

For example and referring to FIG. 1C, the guide 120 may include a guide attachment mechanism 170 that is used to couple the guide 120 to the panel 110. More specifically, the guide attachment mechanism 170 may be placed on an underside (e.g., a side that faces the panel 110) of the guide 120. The guide attachment mechanism 170 is configured to mate with or otherwise be coupled to a panel attachment mechanism 180 provided on the first side of the panel 110. Although the guide attachment mechanism 170 is shown on an underside of the guide 120, the guide attachment mechanism 170 may be placed on multiple sides of the guide 120. Further, each guide 120 may have multiple guide attachment mechanisms 170. In still yet other implementations, the guide attachment mechanism 170 and/or the panel attachment mechanism 180 may be omitted.

In some implementations, the guide attachment mechanism 170, along with the panel attachment mechanism 180 may increase the overall aesthetics of the window covering 100 as the window covering is being manipulated. For example, the guide attachment mechanism 170 in combination with the panel attachment mechanism 180 may keep the guide 120 in a desired place as the panel 110 is being drawn, rolled, folded or otherwise manipulated.

The guide attachment mechanism 170 may extend from a first portion of the guide 120 to a second portion of the guide 120. In one specific yet nonlimiting example, the guide attachment mechanism 170 may extend along the length of the guide 120. Likewise, the panel attachment mechanism 180 may extend from a first portion of the panel 110 to a second portion of the panel 110. In one nonlimiting example, the panel attachment mechanism 180 may extend along the length of the panel 110. In such embodiments, the guide attachment mechanism 170 and the panel attachment mechanism 180 are used to removably couple the guide 120 to the panel 110.

In other implementations, various guide attachment mechanisms 170 and corresponding panel attachment mechanisms 180 may be placed at various locations along a length of the guide 120 and the panel 110 respectively. For example, a first portion of the guide 120 may have a first guide attachment mechanism 170 while a second portion of the guide 120 may have a second guide attachment mechanism 170.

In order to couple the guide 120 to the panel 110, a first panel attachment mechanism 180 may be placed at a first location on the panel 110 that corresponds with the placement of the first guide attachment mechanism 170 on the guide 120. Likewise, a second panel attachment mechanism 180 may be placed at a second location on the panel 110 that corresponds with the placement of the second guide attachment mechanism 170 on the guide 120. Although the various guide attachment mechanisms 170 may be spaced apart from one another such that a continuous coupling between the guide 120 and the panel 110 is not provided, the guide 120, and one or more securement mechanisms 130, may still be coupled to the panel 110 at those locations and still function in a similar manner as described above.

In yet another embodiment, the guide 120 may be both removably coupled to the panel 110 and nonremovably coupled to the panel 110. For example, a first portion of the guide 120 may be sewn or otherwise securely attached to a first portion of the panel 110 while a second portion of the guide 120 is removably coupled to the panel 110 using the guide attachment mechanism 170 and a corresponding panel attachment mechanism 180. In such embodiments, each portion of the guide 120 may have a corresponding securement mechanism 130. Thus, each securement mechanism 130 may move to various continuous points along the guide 120 in the sections that contain the coupling between the guide attachment mechanism 170 and the panel attachment mechanism 180 (but may not move to a different section).

The guide attachment mechanism 170 and the panel attachment mechanism 180 may be any type of attachment mechanism operative to engage with one another. For example, the guide attachment mechanism 170 and the panel attachment mechanism 180 may be buttons, magnets, zippers, snaps, hook and loop fasteners or closures, an adhesive fastener (e.g., Velcro) and so on.

Because the guide attachment mechanism 170 and the panel attachment mechanism 180 engage and disengage from one another, the securement mechanisms 130 may move along and be secured at various continuous points along the guide 120. Further, the securement mechanism 130 may move along the guide with little to no resistance.

For example, even if the guide attachment mechanism 170 and the panel attachment mechanism 180 are coupled together, movement of the securement mechanism 130 along the guide 120 may cause these components to temporarily disengage. In another embodiment, the guide attachment mechanism 170 and the panel attachment mechanism 180 may be manually disengaged by a user.

Once the securement mechanism 130 is positioned at the desired location along the guide 120, the guide attachment mechanism 170 and the panel attachment mechanism 180 may be reengaged. Once reengaged, the securement mechanism 130 is held at that location.

Although the securement mechanisms 130 are illustrated as separate components, the embodiments described herein are not so limited. For example, a first securement mechanism 130 on a first guide 120 may be coupled to a second securement mechanism 130 on a second guide 120. Put another way, a single securement mechanism 130, such as a strap, a band or the like, may extend from the first guide 120 to the second guide 120. In such an implementation, the panel 110 may be threaded or otherwise placed through the strap to adjust the length and/or the aesthetic look of the window covering 100.

Referring back to FIG. 1A, the window covering 100 may also include a rod 140. The rod 140 may be integrated with the window covering 100. In another embodiment, the rod 140 may be removably coupled to a portion of the window covering 100. The rod 140 is used removably couple the window covering 100 to a window or other opening.

The rod 140 may be spring-loaded which enables the rod 140 to be compressed prior to being placed in a window or other such opening. When the rod 140 is at the desired location within the opening, the rod 140 expands thereby securing the window covering 100 within the opening. The rod 140 may be compressed and expanded any number times including when the window covering is drawn to various lengths. As such, the window covering 100 may be moved and placed at any number of continuous positions within the window.

Although a rod 140 is specifically mentioned, the window covering 100 may be coupled to a window using other attachment devices. For example, the window covering 100 may be coupled to a window or opening using a track, a bracket, a hinge and, hook and loop fasteners, or any other such device that may be used to permanently secure, temporarily secure or removably secure the window covering 100 to a window or other such opening.

The window covering 100 may also include a structure component 160. The structure component may be integrated with the window covering 100. In another embodiment, the structure component 160 may be removably received into a portion (e.g., a bottom portion) of the panel 110. The structure component 160 may be weighted in order to provide stability and/or to help restrict movement of the window covering 100. The structure component 160 may also be used to roll, fold or otherwise manipulate the panel 110 as the length of the panel 110 is changed such as will be described below.

FIG. 1B illustrates a back side of the example window covering 100 of FIG. 1A. The back side of the window covering 100 includes one or more attachment mechanisms 150. The attachment mechanisms 150 may be positioned opposite the guide 120, the guide attachment mechanism 170 and the corresponding panel attachment mechanism 180. The attachment mechanism 150 may extend along the length of the panel 110, substantially along a length of the panel 100, partially along a length of the panel 110 and so on. In some embodiments, the attachment mechanism 150 may be continuous or segmented. In other embodiments, the attachment mechanism may be arranged in a vertical orientation, a horizontal orientation, a diagonal orientation and so on.

The attachment mechanisms 150 may be coupled to the securement mechanism 130 when the panel 110 is manipulated, drawn, rolled or folded such as will be described below. As such, the attachment mechanism 150 may be any type of mechanism that may be removably coupled to the securement mechanism 130.

For example, the securement mechanism 130 may include a feature that is operative to be removably coupled to the attachment mechanism 150. In one nonlimiting example, the securement mechanism 130 may have a male coupling mechanism while the attachment mechanism comprises a female mating mechanism or vice versa. In other embodiments, the attachment mechanism 150 and the corresponding feature on the securement mechanism 130 may be may be buttons, zippers, snaps, hook and loop fasteners or closures, plastic hooks, adhesive fastening products and so on.

Although not shown, the back side of the window covering 100 may also include one or more guides. The guides on the back side of the window covering 100 may be similar to the guides 120 described above. In some implementations, the guides may be removably coupled to the attachment mechanism 150. When guides are positioned on the back side of the window covering 100, the guides may include one or more securement mechanisms, such as, for example, securement mechanism 130. These guide and securement mechanisms may function similar to those described above. That is, the guides and securement mechanisms may be used to cause the window covering 100 to have various continuous lengths such as described above.

Figure 2A:
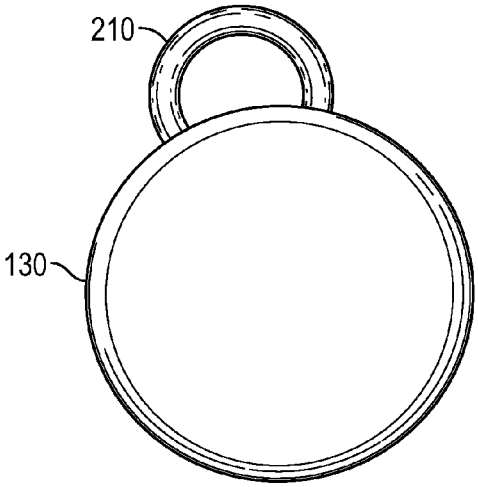
FIG. 2A illustrates an example sliding securement mechanism that may be used with the example window covering of FIG. 1A.
Figure 2B:
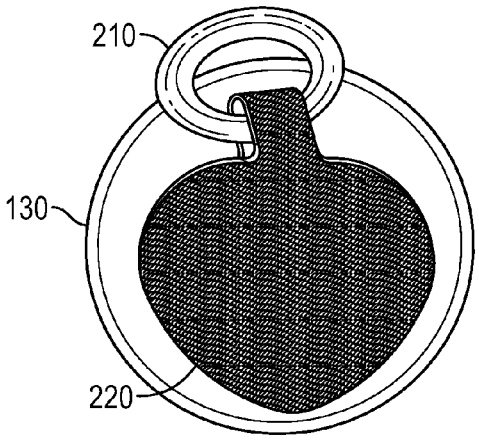
FIG. 2B illustrates a back side of the example sliding securement mechanism of FIG. 2A.

FIGS. 2A-2B illustrate an example securement mechanism 130 that may be used with the window covering 100 of FIG. 1A. Although the securement mechanism 130 is shown as a rounded object, the securement mechanism 130 may take any shape or size. For example, the securement mechanism may be implemented as a button, a pin, a ball, and so on. In other implementations, the securement mechanism 130 may be a strap, a band, a bar, a rail and the like. When in this particular implementation, the securement mechanism 130 may extends from a first guide to a second guide. In other implementations, the securement mechanism 130 may have a variety of shapes, sizes, colors, patterns and so on.

The securement mechanism 130 includes a sliding mechanism 210. The sliding mechanism 210 may be pivotally coupled to a portion of the securement mechanism 130. Because the sliding mechanism 210 may be pivotally coupled to the securement mechanism 130, the angle and/or the position of the securement mechanism 130 may be adjusted once the securement mechanism 130 is positioned on the guide. In some embodiments, the sliding mechanism 210 may be integrally formed with the securement mechanism 130. In yet another implementation, the sliding mechanism 210 may be pivotally or moveably coupled to a panel attachment mechanism 220 (FIG. 2B) provided on an underside of the securement mechanism 130.

The sliding mechanism 210 engages a guide, such as, for example, guide 120 of FIG. 1A. In some embodiments, the guide is threaded or otherwise placed through the sliding mechanism 210. This enables the securement mechanism 130 to move along the guide 120. Although a single sliding mechanism 210 is shown, the securement mechanism may include two more sliding mechanisms 210. For example, a first sliding mechanism 210 may be positioned near a top portion of the securement mechanism 130 and a second sliding mechanism 210 may be positioned near a bottom portion of the securement mechanism 130.

The sliding mechanism 210 may have a rounded configuration although this is not required and other shapes are contemplated. In some embodiments, the sliding mechanism 210 may have an opening (not shown), a clasp or other such mechanism that enables the sliding mechanism to be removably coupled to the guide.

As briefly discussed above, the securement mechanism 130 includes a panel attachment mechanism 220. The panel attachment mechanism 220 may be used to adjust a length of the panel 110. More specifically, when the securement mechanism 130 has been secured at a desired position along the guide 120, the panel attachment mechanism 220 is coupled to an exposed portion of the attachment mechanism 150 on the back side (or an attachment mechanism 150 placed on a front side) of the panel 110.

For example and as will be described below, as the panel 110 is rolled, folded or otherwise manipulated, the attachment mechanism 150 on the back side of the panel 110 may be exposed to the panel attachment mechanism 220. Once the attachment mechanism 150 is exposed, the panel attachment mechanism 220 may be removably coupled to the attachment mechanism 150. As with the other attachment mechanisms described herein, the panel attachment mechanism 220 may be may be a button, a magnet, a zipper, a snap, a hook and loop fastener or closure, an adhesive fastening product and the so on.

Figure 3B:
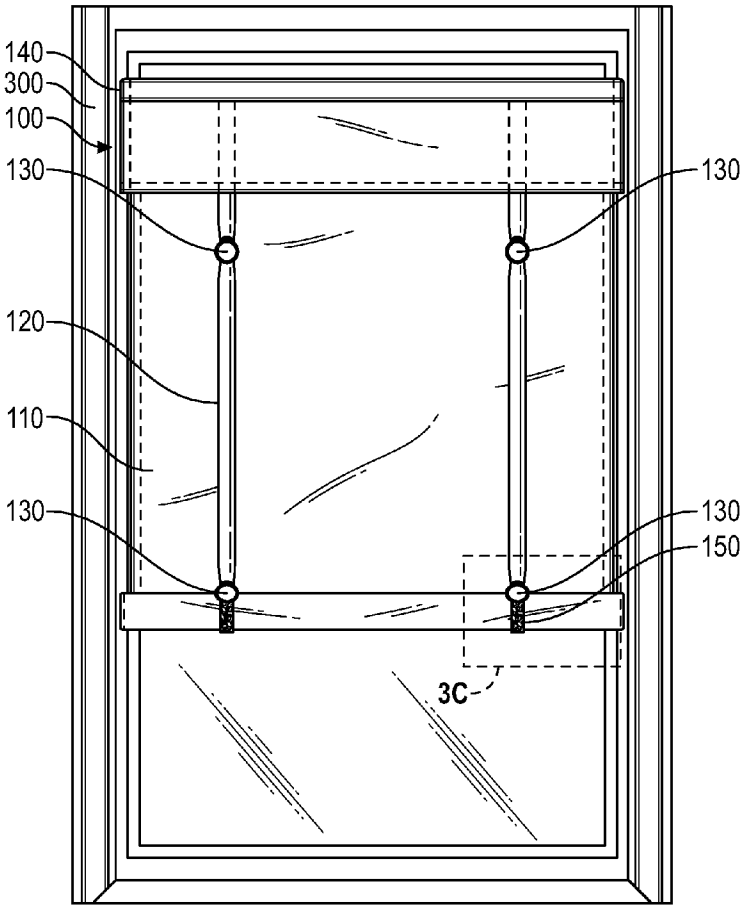
FIG. 3B illustrates the example window covering of FIG. 1A in a first configuration.
Figure 3A:
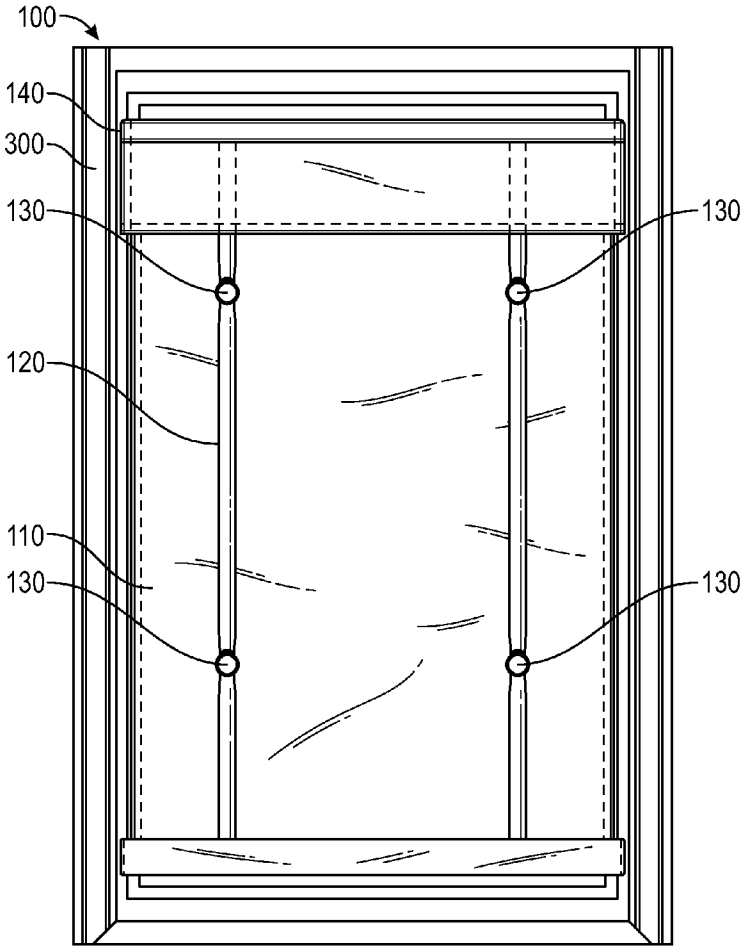
FIG. 3A illustrates the example window covering of FIG. 1A being coupled to a window.

FIG. 3A illustrates an example window covering 100 being attached to a window 300. As shown in FIG. 3A, the rod 140 may be used to position the window covering 100 in a topmost portion of the window 300. In this embodiment, the dimensions of the panel 110 are substantially equivalent to the dimensions of the window 300. As also shown in FIG. 3A, the securement features 130 are positioned at various points along the guides 120.

FIG. 3B illustrates the example window covering 100 in a first configuration. More specifically, the panel 110 of the window covering 100 has been manipulated (e.g., rolled) from the bottom in an upward direction until the panel 110 is adjacent the securement mechanisms 130. In some embodiments, a structural feature (e.g., structural feature 160) may be used to assist in the manipulation process.

Figure 3C:
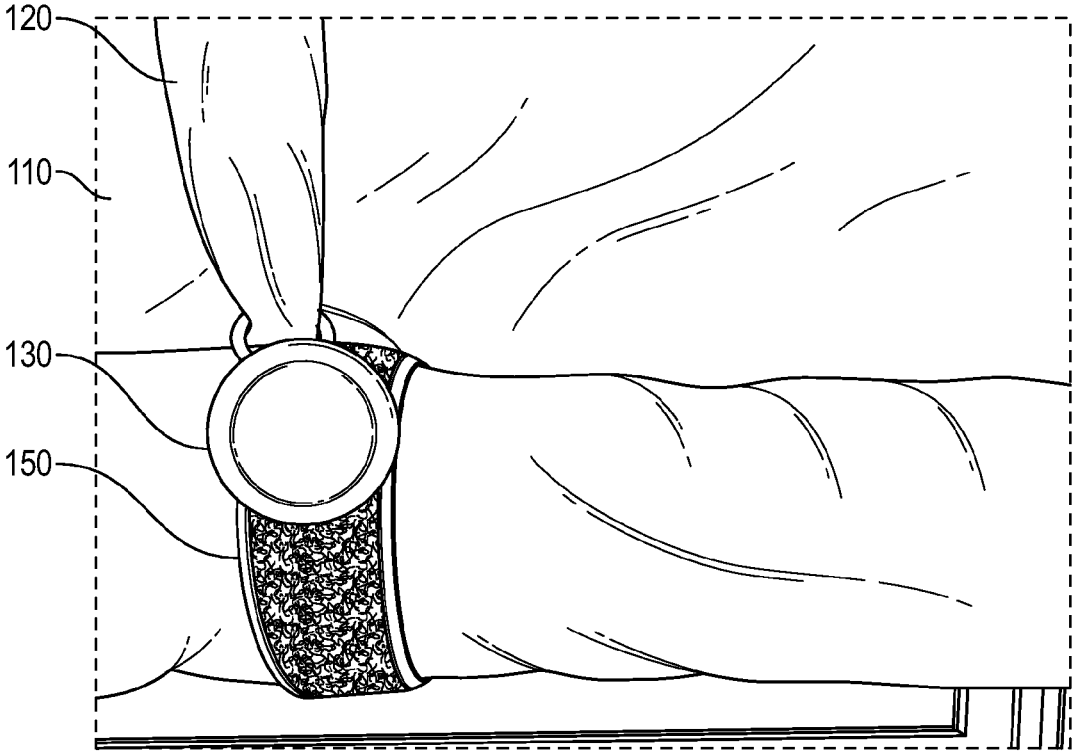
FIG. 3C illustrates close-up view of the window covering of FIG. 3B taken from the dashed rectangle.

Manipulation of the panel 110 causes the attachment mechanism 150 on the back side of the panel 110 to become exposed (such as shown in FIG. 3C). As such, the securement mechanism 130, and more specifically the panel attachment mechanism (e.g., panel attachment mechanism 220 (FIG. 2B)) of the securement mechanism 130 may be removably coupled with the attachment mechanism 150. As such, the length of the panel 110 may be adjusted and secured. Although the attachment mechanism 150 may be exposed as shown, in some embodiments, a covering (not shown) may be coupled to the exposed portion of the attachment mechanism 150. The covering may be look similar to the guide 120 and act to increase the aesthetics of the window covering 100.

Although the panel 110 is manipulated (e.g., rolled) to the position of the bottom pair of securement mechanisms 130 in FIG. 3B, the panel 110 may be rolled or otherwise manipulated such that the panel 110 has any length. For example, the panel 110 may be rolled to the topmost securement mechanisms 130. Alternatively or additionally, the panel 110 may be rolled to any continuous position along the guide 120 so long as a securement mechanism 130 has been positioned or otherwise secured at that location.

As described earlier, the window covering 100 of the present disclosure may be a top-down, bottom-up window covering. That is, the top of the window covering 100 may be placed at any location within the window 300. For example and a shown in FIG. 3D, the rod 140 may be used to place the window covering 100 approximately a third of the way down the window 300. The length of the panel 110 may also be adjusted from the bottom up using the guides 120, the securement mechanisms 130 and the attachment mechanism 150 in the manner described above.

Figure 3E:
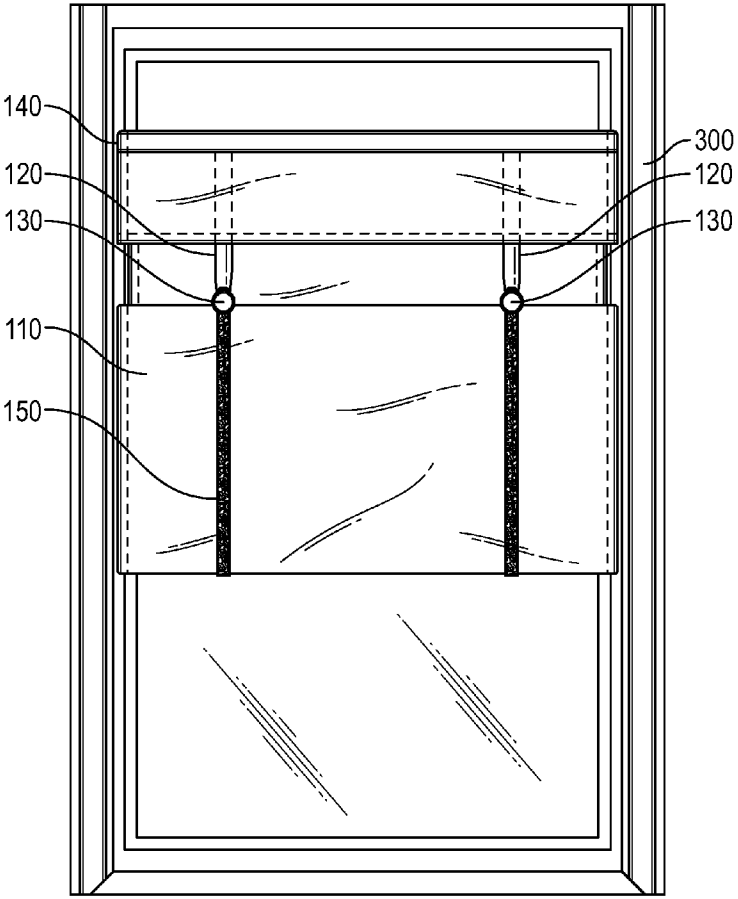
FIG. 3E illustrates the example window covering of FIG. 1A in a third configuration.
Figure 3D:
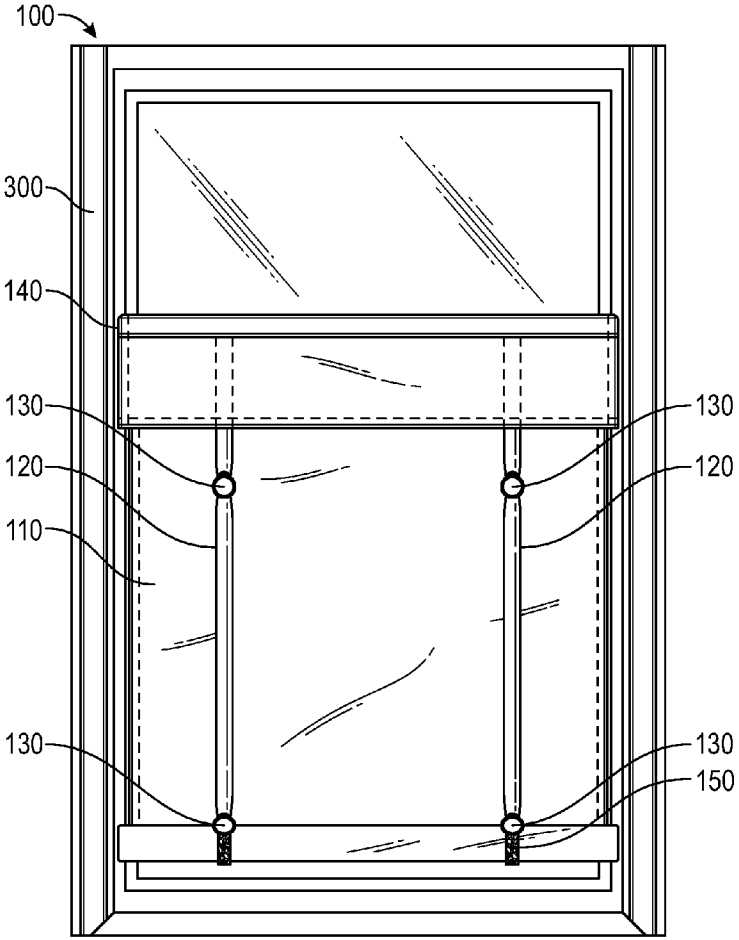
FIG. 3D illustrates the example window covering of FIG. 1A in a second configuration.

FIG. 3E illustrates the example window covering 100 in a third configuration. In this configuration, the panel 110 of the window covering 100 is manipulated in a second manner. More specifically, the panel 110 is folded instead of rolled. However, as shown in FIG. 3E, manipulation of the panel 110 in this manner exposes the attachment mechanisms 150 to the securement mechanisms 130 positioned on the guides 120. As such, the length of the panel 110 may be adjusted such as described above. While in this configuration (as well as in the other configurations described herein), the securement mechanisms may be moved along their guides 120 to further adjust a length of the window covering 100. In addition, the rod 140 may be used to secure the window covering at various locations within the window 300.

Although specific manipulations are shown in these figures, the window covering may have multiple configurations. For example, the different portions of the panel 110 may be coupled to many different securement mechanisms at different locations thereby causing the window covering 110 to have multiple folds. Likewise, a first portion of the window covering 100 may be rolled and subsequently folded (e.g., combining the first configuration and the third configuration).

Figure 4:
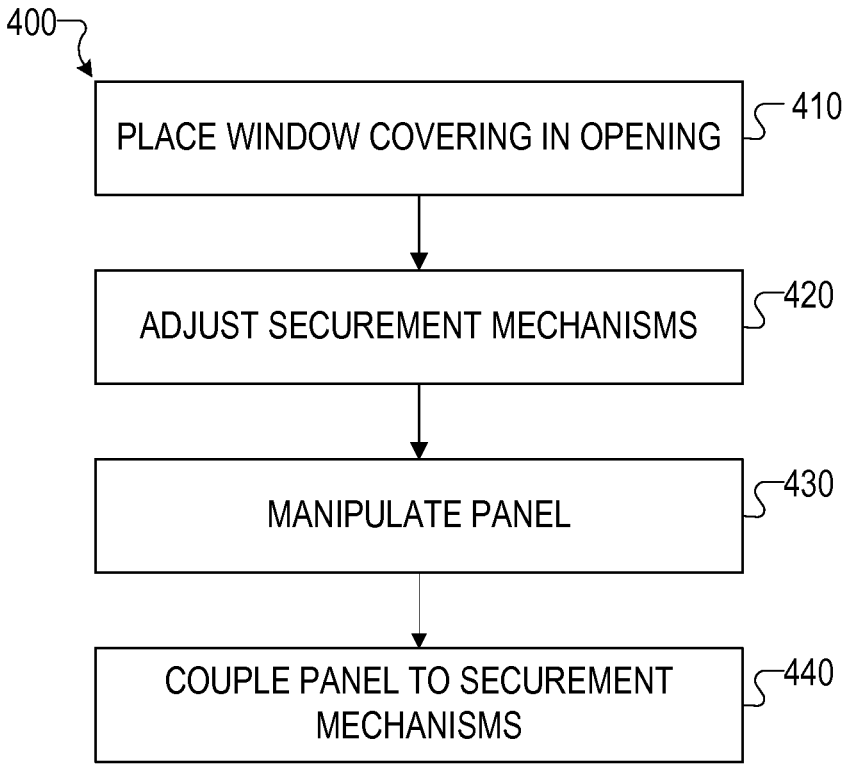
FIG. 4 illustrates a method for adjusting a length of a window covering.

FIG. 4 illustrates a method 400 for manipulating a window covering. The method 400 may be used to manipulate the window covering 100 and/or various features of the window covering 100 shown and described above with respect to FIGS. 1A-3E.

The method 400 begins at operation 410 in which the window covering is placed in an opening. As described above, the window covering may be placed at any position within the window. For example, a rod or other such mechanism may be used to removably couple the window covering to any portion of the window.

Once the window covering has been secured in the window, flow proceeds to operation 420 and one or more securement mechanisms 420 of the window covering may be adjusted. In some embodiments, the securement mechanisms may be moveably coupled to one or more guides on the window covering. As described above, the securement mechanisms may be placed in any location of a continuous range of locations along the guides of the panel.

As the securement mechanisms move along the guides, the guides may be temporarily decoupled from a panel of the window covering. Once the securement mechanisms have been positioned at a desired location, the guide may again be coupled to the panel. In some embodiments, the securement mechanism itself may have a protrusion or other feature that is operative to recouple the guide to the panel. Recoupling the guide in this manner secures the securement mechanism at the desired location.

Flow then proceeds to operation 430 and the panel of the window covering is manipulated. For example, the panel may be rolled and/or folded (e.g., from the bottom up) or otherwise manipulated such that the panel has a desired length. Manipulation of the panel in this manner may expose one or more attachment features positioned on a back side of the panel.

Flow then proceeds to operation 440 and the panel is coupled to the securement mechanisms. More specifically, in this operation, the exposed attachment features on the back side of the panel are coupled to one or more panel attachment features associated with the securement mechanisms. Although the back side of panel is mentioned as having attachment features, the front side of the panel may also have one more attachment features. These attachment features may be used to manipulate the panel in a similar manner as described above. In some embodiments, the attachment features may be positioned at various locations and positions on the front side of the panel and/or the back side of the panel.

Further, although a top-down, bottom-up configuration is specifically mentioned, it is contemplated that the embodiments described herein may also be arranged in a top-down, side-to-side configuration, or simply a side-to-side configuration. For example, the window covering may be placed at a desired position within the window and then drawn or otherwise manipulated such that a width of the window covering may be adjusted. For example, a first side or a first edge (e.g., a right side or right edge) of the window covering is removably coupled to a second side or second edge (e.g., a left side or left edge) of the window covering and vice-versa.

Although illustrated and described in a particular order, the operations described above with respect to FIG. 4 may occur in any order. Additionally, one or more operations may be removed or executed concurrently or substantially concurrently. For example, two blocks shown in succession may be executed concurrently substantially concurrently. Additionally, the operations may be executed in the reverse order.

This disclosure described some embodiments of the present disclosure with reference to the accompanying drawings, in which only some of the possible embodiments were shown. Other aspects may, however, be embodied in many different forms and should not be construed as limited to the embodiments or examples set forth herein. Rather, these embodiments and examples were provided so that this disclosure was thorough and complete and fully conveyed the scope of the possible embodiments to those skilled in the art.

What is claimed is:

1. A window covering, comprising:

a panel having a first face and a second face, wherein the second face of the panel is opposite the first face of the panel;

a first attachment mechanism coupled to the first face of the panel and extending along substantially an entire length of the first face of the panel;

a second attachment mechanism coupled to the second face of the panel;

a guide having a length that is substantially equivalent to the first attachment mechanism and being removably coupled to the first attachment mechanism along substantially an entire length of the first attachment mechanism; and a securement mechanism coupled to the guide and operative to move along the length of the guide and be secured, by at least a portion of the guide and at least a portion of the first attachment mechanism, at any of a plurality of continuous positions along the length of the guide;

wherein the securement mechanism secures at least a portion of the panel at any of the plurality of continuous positions by moving the securement mechanism to one of the plurality of continuous positions along the length of the guide and removably coupling the securement mechanism to at least a portion of the second attachment mechanism.

2. The window covering of claim 1, wherein the securement mechanism comprises a third attachment mechanism and wherein the third attachment mechanism is removably coupled to the second attachment mechanism when the at least the portion of the panel is secured at any of the plurality of continuous positions.

3. The window covering of claim 1, wherein at least a portion of the guide is a fabric.

4. The window covering of claim 1, wherein the sliding securement mechanism comprises a pivotable sliding mechanism.

5. The window covering of claim 1, wherein the second attachment mechanism extends substantially along a length of the second face of the panel.

6. The window covering of claim 1, further comprising a folding structure positioned within at least a portion of the window covering.

7. The window covering of claim 6, wherein the folding structure is weighted.

8. The window covering of claim 1, wherein the second attachment mechanism is coupled to a second guide.

9. A window covering, comprising:

a first face having a front attachment mechanism extending along substantially an entire length of the first face;

a second face opposite the first face;

a guide extending along substantially the entire length of the first face, wherein the guide is removably coupled to the front attachment mechanism along substantially an entire length of the front attachment mechanism;

a rear attachment mechanism coupled to the second face; and a securement mechanism moveably coupled to the guide and securable by the guide at any of a plurality of securement positions located continuously along a length of the guide;

wherein the guide is operative to secure the window covering at any of a plurality of continuous positions by moving the securement mechanism to one of the plurality of securement positions and coupling the securement mechanism to the rear attachment mechanism.

10. The window covering of claim 9, wherein at least a portion of the guide is concealed within a manipulated portion of the window covering when the window covering is secured to the one of the plurality of positions.

11. The window covering of claim 9, wherein the securement mechanism is at least one of a button, a hook, a magnet, or a snap.

12. The window covering of claim 9, wherein the securement mechanism comprises an adhesive fastener.

13. The window covering of claim 9, further comprising a bar operative to removably couple the window covering to a window.

14. The window covering of claim 9, further comprising a folding structure positioned at the bottom portion of the window covering.

15. The window covering of claim 14, wherein the folding structure is weighted.

16. A window covering, comprising:

a first face having a first front attachment mechanism and a second front attachment mechanism, wherein the first and second front attachment mechanisms extend along substantially an entire length of the first face;

a second face opposite to the first face;

a first rear attachment mechanism coupled to the second face of the window covering;

a second rear attachment mechanism coupled to the second face of the window covering;

a first guide extending along substantially an entire length of the first face of the window covering and being removably coupled to the first front attachment mechanism along substantially an entire length of the first front attachment mechanism;

a second guide spaced apart from the first guide and extending along substantially an entire length of the first face of the window covering and being removably coupled to the second front attachment mechanism along substantially an entire length of the first front attachment mechanism;

a first securement mechanism movably coupled to the first guide and securable, by at least a portion of the first guide, at any of a plurality of first securement positions located continuously along a length of the first guide;

a second securement mechanism movably coupled to the second guide and securable, by at least a portion of the second guide, at any of a plurality of second securement positions located continuously along a length of the second guide;

wherein the first guide and the second guide are operative to:

secure the window covering at any of a plurality of continuous positions by:

moving the first securement mechanism to one of the plurality of first securement positions along the length of the first guide and coupling the first securement mechanism to the first rear attachment mechanism; and moving the second securement mechanism to one of the plurality of second securement positions along the length of the second guide and coupling the second securement mechanism to the second rear attachment mechanism.

17. The window covering of claim 16, wherein the first guide and the second guide comprise a fabric.

18. The window covering of claim 16, further comprising a weighted folding structure disposed within a portion of the window covering.

19. The window covering of claim 16, wherein the first rear attachment mechanism is coupled to a third guide and wherein the second rear attachment mechanism is coupled to a fourth guide.

20. The window covering of claim 16, wherein at least a portion of one of the first guide and the second guide is concealed within a manipulated portion of the window covering when the first securement mechanism is coupled to the first rear attachment mechanism and when the second securement mechanism is coupled to the second rear attachment mechanism.

* * * * *